US005657805A

United States Patent [19]

Magro

[11] Patent Number: 5,657,805

[45] Date of Patent: Aug. 19, 1997

[54] WIND-RESISTANT OVERHEAD CLOSURE

[76] Inventor: Sebastian Magro, 22 Hallock Meadow Dr., North Stonybrook, N.Y. 11790

[21] Appl. No.: 516,352

[22] Filed: Oct. 3, 1995

[51] Int. Cl.[6] ..... E06B 9/08

[52] U.S. Cl. ..... 160/133; 160/41; 160/290.1

[58] Field of Search ..... 160/133, 290.1, 160/269, 273.1, 41, 271, 265

[56] References Cited

U.S. PATENT DOCUMENTS

| | | | |
|---|---|---|---|
| 1,918,415 | 7/1933 | Miller | 160/273.1 |
| 2,839,135 | 6/1958 | Anderson | 160/133 |
| 3,076,499 | 2/1963 | Zoll et al. | 160/41 |
| 3,489,200 | 1/1970 | Recchione | 160/133 |
| 3,732,913 | 5/1973 | Wrono | 160/133 |
| 3,734,161 | 5/1973 | Pierce | 160/235 X |
| 4,234,033 | 11/1980 | Leivenzon et al. | 160/133 |
| 4,601,320 | 7/1986 | Taylor | 160/133 X |
| 4,630,664 | 12/1986 | Magro . | |
| 5,275,223 | 1/1994 | Magro et al. . | |
| 5,419,386 | 5/1995 | Magro et al. . | |

*Primary Examiner*—David M. Purol

*Attorney, Agent, or Firm*—Lackenbach Siegel Marzullo Aronson & Greenspan, P.C.

[57] ABSTRACT

A wind-resistant overhead door includes substantially vertical windbars mounted on the side portions of the frame, and windlocks or endlocks on the lateral edge portions of the intermediate and bottommost of endmost slats of the closure, such as a rolling door. By providing a predetermined clearance between the windbars and windlocks by substantially eliminating such clearance with respect to the lowermost or endmost slat or bar, maximum flexing of the slats in response to wind loads and positive and negative pressures acting on the closures can be substantially eliminated to thereby control and substantially eliminate undesired deflections or gaps about the periphery of the closure. This minimizes the exposure to which glass elements behind the closures are exposes to wind loads, and pressures which can damage the same.

20 Claims, 6 Drawing Sheets

FIG. 1
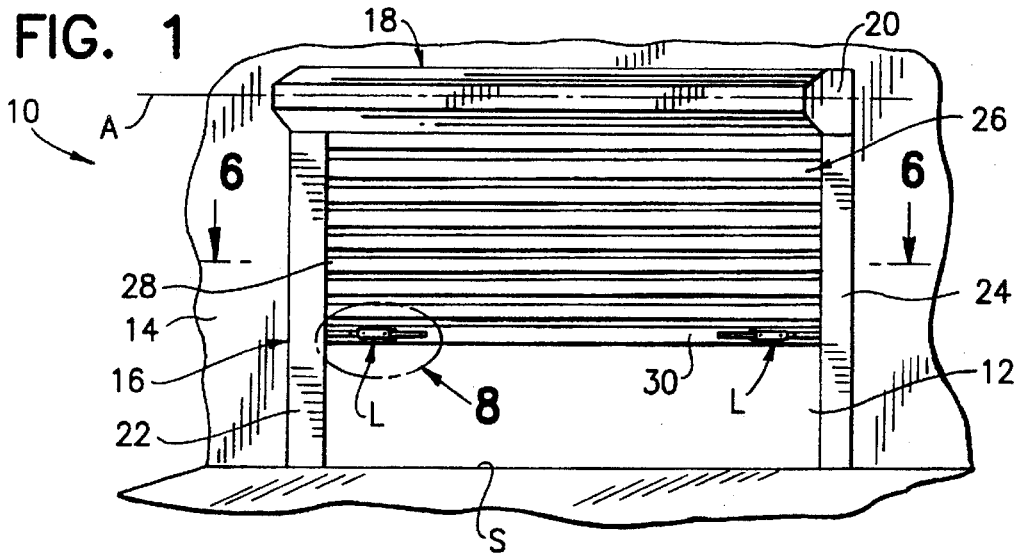
FIG. 2
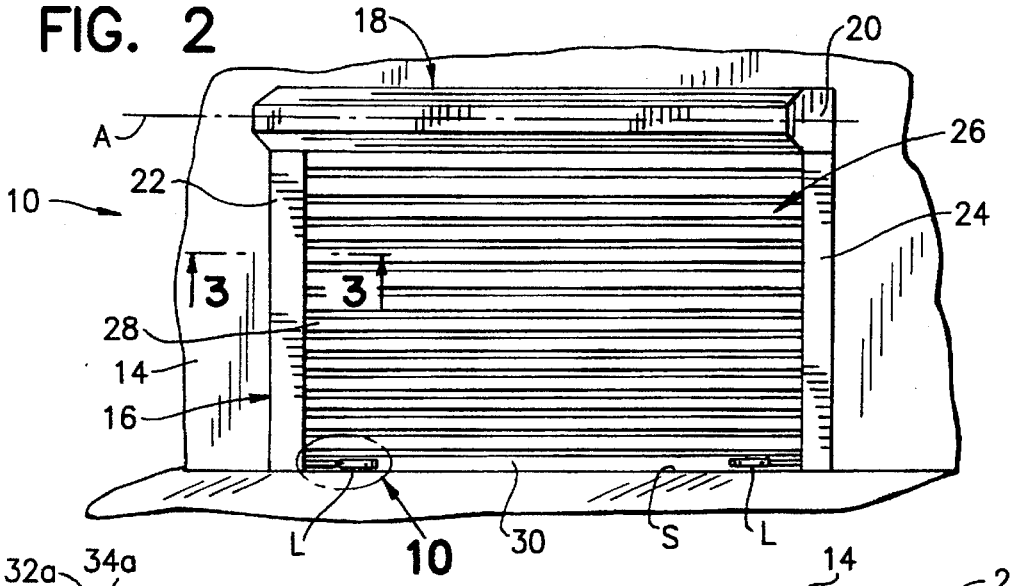
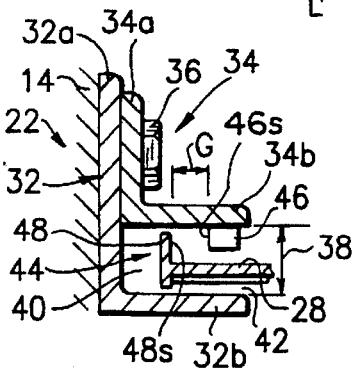
FIG. 3
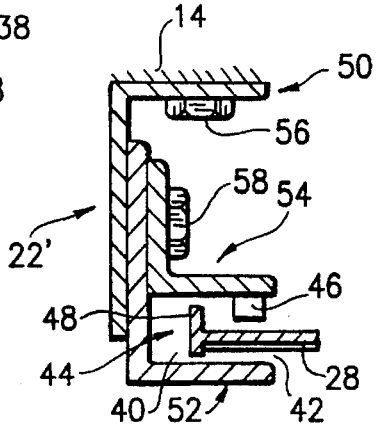
FIG. 4
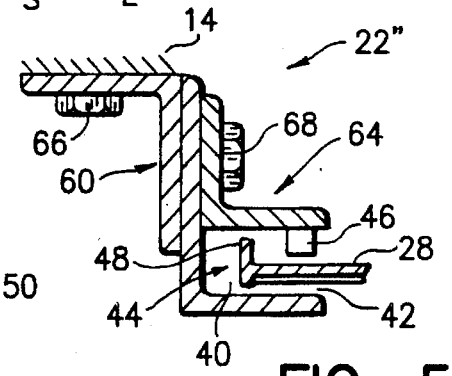
FIG. 5

WIND-RESISTANT OVERHEAD CLOSURE

BACKGROUND OF THE INVENTION

1. Field of the Invention

This invention generally relates to closures for openings in building structures, and more specifically, to closures which are wind-resistant, such as a wind-resistant overhead door.

2. Background of the Invention

Closure devices for protecting openings in building structures, such as doors and windows, are frequently relied upon not only to provide security for the building structure by preventing unauthorized access to the structure, but are frequently also relied upon to protect the structure from severe natural climatic conditions. To the extent that doors and windows are made of glass, these are practicularly susceptible to certain climatic conditions, in particular hurricanes, cyclones and tornadoes. Glass which is frequently used to close openings in building structures are not only susceptible to being destroyed by flying debris during such adverse climatic conditions, but can also be destroyed as a result of dynamic and/or static air pressure differentials on the two sides of the windows, doors or the like. As a result of the dangers posed by these naturals climatic conditions, a number of States and local governments have enacted rules and relations in order to prevent or minimize damage. The State of Florida, for example, has enacted such relations and building codes due to the frequent occurrences of hurricanes in a number of counties in Florida, such as Dade and Broward counties.

One approach to ameliorate the problem has been to use shutters which are hingedly mounted on each side of the opening of the structure. However, such shutters, to be effective, have been made of heavy materials such as steel, are not conducive for automatic operation and are relatively expensive. Rolling, slatted doors and shades have also been used. These are typically rolled up in a coil at the top of the opening and unrolled to cover the entire opening exteriorly of the glass windows and doors. While such rolling closures have been effective to prevent impact by flying debris, they typically flex or bend when subjected to positive or negative pressures on the outside of the structure. However, such bending or flexing of the slats outside of the plane of the building structure effectively shortens the lengths of these slats by moving the ends inwardly, particularly on the sides and on the bottom of the door. While some known designs have attempted to limit the lateral inward movements of the ends of the slats to thereby prevent excessive bowing or flexing of the slats outside the plane of the rolling closure, these have not prevented excessive upward deflection of the lowermost slat due to the cumulative flexing of the intermediate slats, particularly at the central region or at points of the closure slats most remote from the lateral or anchored points. Such bending or flexing, therefore, creates an opening at the bottom of the slatted closure. This opening, if excessive, can be sufficient to create positive or negative pressure conditions between the slatted closure and the glass components of the window or door. Unless such bending or flexing is controlled, therefore, damage can still be caused by a severe hurricane, tornado or the like.

SUMMARY OF THE INVENTION

It is, accordingly, an object of the present invention to provide a wind-resistant closure device which does not have the disadvantages inherent in the prior art closure devices.

It is another object of the present invention to provide a wind-resistant closure for doors and windows which is simple in construction and economical to manufacture.

It is still another object of the present invention to provide a wind-resistant closure device which is easy to use and can be automated in its operation for opening or closing the same.

It is yet another object of the present invention to provide a wind-resistant closure device which can protect openings in building structures such as windows and doors, under extreme wind, positive or negative pressure conditions.

It is a further object of the present invention to provide a wind-resistant overhead door which conforms with the codes of various States or local governments, such as those established by the South Florida Building Code, 1994 Edition, and Broward County, 1994 Edition.

It is still a further object of the present invention to provide a wind-resistant closure which can be used both with doors as well as windows.

It is yet a further object of the present invention to provide a wind-resistant closure as suggested in the previous objects, in the form of roll down closure, which prevents or minimizes lateral openings, on both sides of the closure as well as a bottom opening at the bottom of the closure.

It is an additional object of the present invention to provide a wind-resistant overhead door which achieves the above objects.

It is an additional object of the present invention to provide a wind-resistant closure mechanism which can be used with windows and doors having a wide range of widths.

In order to achieve the above objects as well as others which will become apparent hereinafter, a wind-resistant closure, such as an overhead door, in accordance with the present invention is provided for a generally rectangular opening in a wall of a building structure. The wind-resistant closure comprises a frame defining a plane dimensioned to conform to the wall opening. Said frame includes an upper horizontal portion and spaced vertical side portions. A rolling door having an endmost door portion which is variably movable from said upper horizontal portion and a plurality of intermediate door portions between said upper horizontal portion and said endmost door portion, said door portions extending between said side portions and has lateral edge portions which cooperate with and are guided by said frame side portions. Rolling means is provided generally extending along said upper horizontal portion for rolling up said rolling member about an axis generally co-extensive with said upper horizontal portion of said frame to open the overhead closure and for unrolling said rolling member and guiding said lateral edge portions along associated vertical side portions to close the overhead closure. Said vertical side portions include first stop means for limiting the lateral movements of said lateral edge portions of said intermediate door portions beyond a predetermined amount at each side portion towards the other side portion and second stop means for preventing any lateral movements of said lateral edge portions of said endmost door portion. In this manner, the actions of said first and second stop means control the extent of inward movements of said edge portions and thereby limit the amount of flexing of said intermediate door portions of said rolling member due to wind loads on the closure in relation to the plane of said frame and flexing of said endmost door portion the direction of said upper horizontal portion of said frame.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 1 is a front elevational view of a wind-resistant overhead door in accordance with the present invention shown in a building structure and in a partially opened condition;

FIG. 2 is similar to FIG. 1, but shows the rolling door in a fully closed condition;

FIG. 3 is a cross sectional view of the left vertical side portion or guide of the frame as shown in FIG. 1, taken along line 3—3, which supports and guides the horizontal slats when the rolling door opens and closes;

FIG 4 is similar to FIG. 3 but shows a different arrangement using three angle irons instead of two for the vertical side portion or guide;

FIG. 5 is similar to FIG. 3 but shows a different arrangement using three angle irons instead of two for the vertical side portion or guide;

DESCRIPTION OF THE PREFERRED EMBODIMENT

Figure 6:
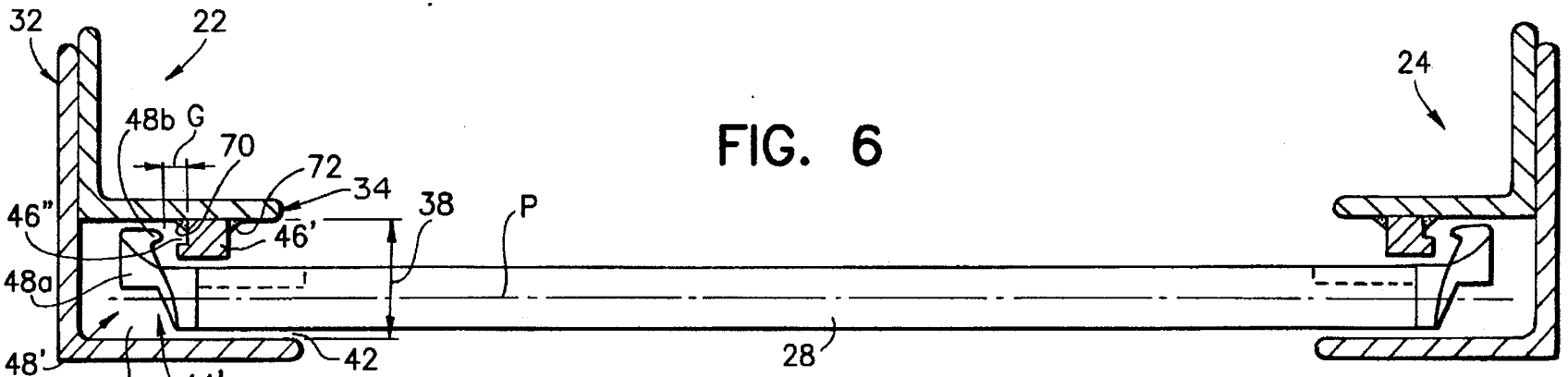
FIG. 6 is a cross sectional view of the wind-resistant overhead door as shown in FIG. 1, taken along line 6—6, during normal use when the door is relaxed and not subjected to external forces.

The present invention will now be more specifically described with relation to the figures, in which identical or similar parts are designated by the same reference numeral throughout. FIG. 1 illustrates an overhead door 10 which incorporates the features of the present invention. While an overhead wind-resistant door will be described to illustrate the invention, it will be clear from the description that follows that the same features, designs and features described in connection with a closure in the form of an overhead door 10 can equally be used in connection with any closures for windows or other generally rectangular openings in building structures.

In FIG. 1, the overhead door 10 is used to open and close a generally rectangular opening 12 in a wall 14 of the building structure. The overhead door 10 includes a frame generally designated by the reference numeral 16, which defines a plane P (FIG. 6) and is dimensioned to conform to the wall opening. The frame 16 includes an upper horizontal portion 18. Typically, the upper horizontal portion 18 includes an enclosure or hood 20 which houses a rotatably mounted horizontal shaft (not shown), as well known to those skilled in the art. The frame 16 also includes spaced vertical side portions 22, 24 which support and guide a rolling member or door 26. The rolling door 26 extends between the side portions 22, 24 and is typically formed of a plurality of intermediate closure portions in the form of articulated intermediate slats 28. An endmost closure portion in the form of an endmost slat 30 is arranged at a point most remote from the enclosure or hood 20 when the rolling door 26 is an a closed position, as shown in FIG. 2.

The intermediate slats 28 and endmost slat 30 have lateral edge portions, to be more specifically described below, which cooperate with and are guided by the frame side portions 22, 24. The rotatably mounted shaft within the enclosure hood 20 serves as a rolling means which extends generally along the upper horizontal portion 18 for rolling up the rolling door 26 about an axis A generally co-extensive with the upper horizontal portion 18 of the frame to unroll the rolling door and thereby open the overhead door and guide the lateral edge portions along the associated vertical side portions to close the overhead door.

An important feature of the present invention/s the provision of stop means on the vertical side portions 22, 24 for limiting the lateral movements of the lateral edge portions at each side portion towards the other side portion. Therefore, the side portions on the left side of the slats 28, 30, as viewed in FIG. 2, are limited in the amount of movement that they can experience in the direction of the vertical side portion 24 on the right side, while the lateral edge portions guided through the vertical side portion 24 on the right side are limited in the degree that they can be displaced towards the vertical side portion 22 on the left side. In this way, such stop means, to be more fully described below, limit the lateral movements of the lateral edge portions associated with each side portions towards the other side portion. Such stop means, therefore, control the extent of inward movements of the edge portions towards the centers of the slats 28, 20, to thereby limit the amount of flexing of the rolling door 26, in relation to the plane of the frame 16, due to wind loads on the door.

Referring to FIG. 3, the details of one design in accordance with the present invention is illustrated. More specifically, FIG. 3 illustrates a top plan view in cross section of the vertical side portion 22 shown in FIG. 1 in which the vertical side portion or guide 22 includes an external angle iron 32 formed of orthogonal portions 32*a*, 32*b*. An interior angle iron 34 has a portion 34*a* which is smaller than the portion 32*a* and an orthogonal portion 34*b* which is substantially equal to the size of the portion 32*b*. When secured to each other and to the wall 14 by a bolt 36 as shown, the angle iron portions 32*b*, 34*b* are spaced from each other a distance 38. While the distance or space 38 is not critical, it has been determined that a distance 38 within the range of 1–2 inches is suitable, and a distance 38 of approximately 1.375 inches has proven to be satisfactory.

The space between the angle iron portions 32*b*, 34*b* forms a generally vertical channel 40 in the side portion 22 which is open on the side thereof facing the other side portion 24 to form a slot 42 though which the lateral edge portion 44 of the various slats 28, 30 of the rolling door 26 can extend.

An important feature of the present invention is the provision of stop means in the form of first and second protuberances, 46, 48 which are arranged in each slot 42 and on an associated lateral edge portion 44, respectively. The first and second protuberances 46, 48 are normally spaced from each other a predetermined distance to provide a predetermined clearance or gap G between the first and the second protuberances when the rolling door 26 is relaxed and not subjected to a wind load, in order to facilitate opening and closing of the rolling door when arranged in the plane P of the frame 16. Flexing of the rolling door, when subjected to a wind load or external pressure, causes the first and second protuberances 46, 48 to approach and ultimately engage each other to inhibit further movements of opposing lateral portions 44 towards each other to thereby prevent further flexing of the rolling door beyond a predetermined amount of flexing or bowing.

While the specific designs of the first and second protuberances 46, 48 is not critical, numerous protuberances pairs can be employed to achieve the objects of the present invention with varying degrees of advantages. The protuberance 46 mounted on the angle iron portion 34*b* is in the form of a generally vertical reetangular bar stop or windbar 46 just inside the slot or access opening 42 between the two angle iron portion 32*b*, 34*b*. The protuberance 48, which is provided along the edge of the lateral edge portion 44 is in the form of a windlock or endlock 48. The stop or windbar 46 is provided with a stop surface 46S and the windlock or endlock 48 is provided with a stop surface 48S which are arranged to engage each other when the slats 28, 30 flex beyond a predetermined amount. Thus, when the slats 28, 30 are in the relaxed and undeflected condition and are in the plane P of the frame the stop surfaces 46S, 48S are spaced from each other a predetermined amount to form a predetermined clearance or gap G. When the slats are flexed due to positive or negative wind pressures, the lengths of the slats within the plane P of the frame 16 effectively shorten and cause the wind locks or end locks 48 to move towards the stops or of the fixed windbars 46 until the stop surfaces 46S, 48S engage. It will be appreciated that once such engagement takes place, the effective lengths of the slats within the plane P can no longer be shortened and, therefore, further flexing of such slats is prevented. The size of the clearance or gap G is not critical for purposes of the present invention and will vary as a function of a number of factors, including the width of the door, the nature of the slats, the maximum anticipated wind loads or pressures to which the slats are to be exposed, etc. The following maximum clearances or gaps G have been found to be suitable: 0.344 inches for a 12 inch wide door; 0.6875 inches for a 16 inch wide door; 0.875 inches for a 20 foot wide door; 1.25 inches for a 24 foot wide door; and 1.5 inches for a 28 foot wide door. The maximum deflections $B_m$ (FIG. 6A) of the rolling door 26 corresponding to the aforementioned predetermined clearances or gaps G are 6.10 inches, 9.95 inches, 12.55 inches, 16.44 inches and 19.45 inches. All these figures are given by way of examples only, as other factors may come into play which may modify these figures in a given situation.

The configuration of the two angle irons 32, 34 as shown in FIG. 3 form an "F" mount 16*a*. Referring to FIG. 4, three angle irons 50, 52 and 54 are connected to the wall 14 of the building structure and to each other by means of bolts 56, 58 as shown. It is clear that with such an "E"-mount configuration 16*b*, the channel 40 can be selected to have corresponding dimensions as shown in FIG. 3, and the windlock and windbar stop protuberances can likewise be the same. Similarly, a "Z"-mount arrangement 16*c* is shown in FIG. 5 formed of three angle irons 60, 62 and 64 secured to the wall 14 by bolt 66 and to each other by bolt 68 as shown. Again, the structure forming the actual channel 40 and the stop elements within the channel can be the same as with the other configurations shown in FIGS. 3 and 4.

Figure 7:
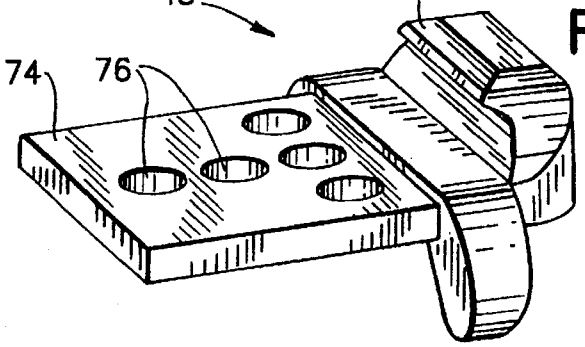
FIG. 7 is an enlarged perspective view of a lateral edge portion of a slat of the door shown in FIG. 1, including the hooked windlock or endlock.
Figure 6A:
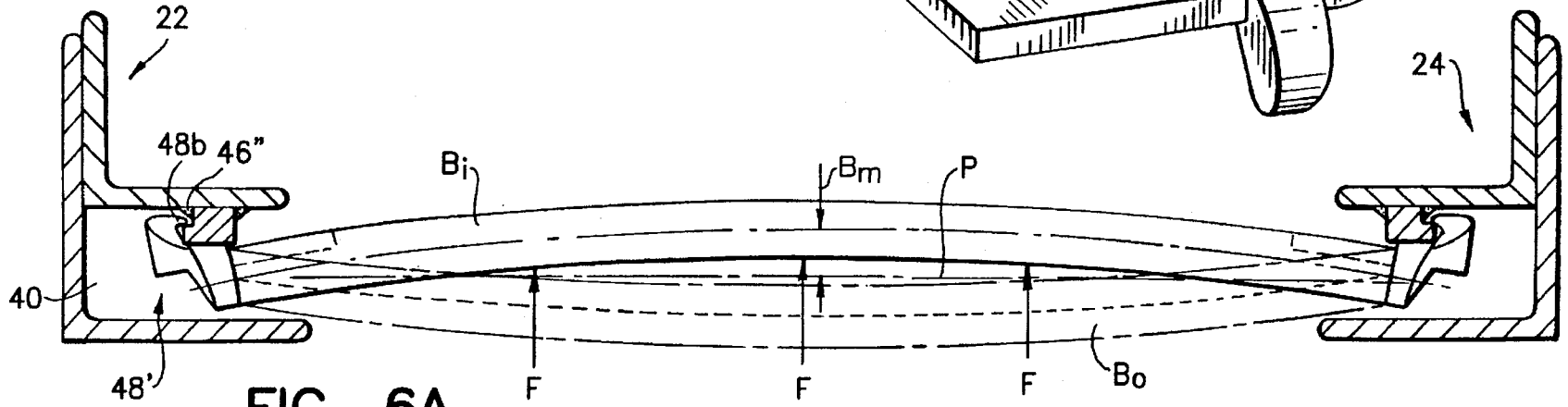
FIG. 6A is similar to FIG. 6 but shows flexing of the rolling door from the relaxed condition shown in FIG. 6 to internally, and externally bowed or flexed positions when exposed to positive and negative external pressures, respectively.
Figures 8, 9:
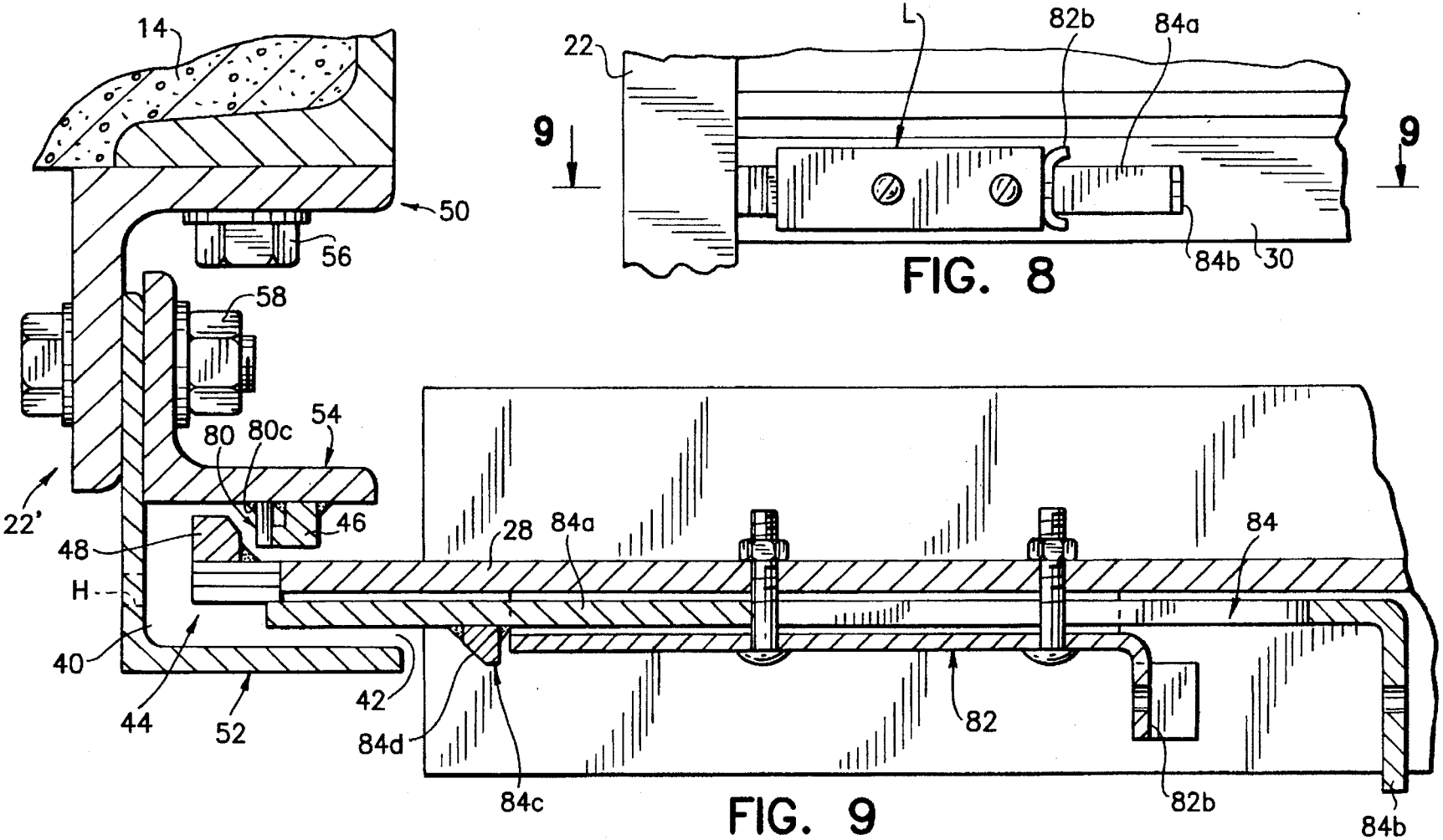
FIG. 8 is an enlarged view of the section designated by the numeral "8" shown in FIG. 1.
FIG. 9 is an enlarged cross sectional view of one side of the wind-resistant door shown in FIG. 8, taken along line 9—9, showing the lock for the door in the open position.
Figure 10:
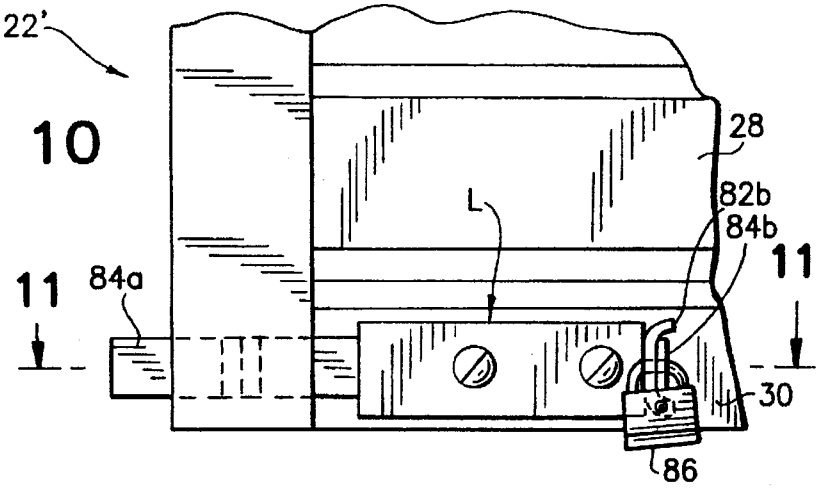
FIG. 10 is similar to FIG. 9, but showing the lock in a closed or locked position.

Referring to FIG. 6, the rolling door of FIG. 1 is illustrated in cross section and in top plan view. The vertical side portions or guides 22, 24 are shown as "F" mounts of the type shown in FIG. 3. However, the stop of windbar 46 of FIG. 3 is illustrated as a modified windbar 46' which is provided with an internal recess or groove 46" as shown. The windlock or endlock 48 of FIG. 3 is similarly modified to correspond to the embodiment shown in FIG. 7, which includes an offset portion 48*a* ending in a hook or pointed portion 48*b*. The windbar 46' is secured to the inner angle iron 34 by means of welds 70, 72 as shown to fixedly secure the same to the frame. When the slat 28 shown in FIG. 6 is in its relaxed condition, it is substantially co-extensive with the plane P of the frame 16 and the pointed portion 48*b* of the windlock 48' is spaced from but substantially aligned with the recess or groove 46" of the windbar 46'. Referring to FIG. 6A, when the outside of the rolling door 26 is exposed to a positive pressure, the slats flex or bow inwardly as indicated in solid outline and designated by the reference $B_i$. When the outside of the rolling door is exposed to a negative pressure, the slat goes outwardly as designated by the reference $B_o$ and indicated in phantom outline. The arrows F indicate the forces acting on the door. These forces can, as noted, be positive or negative forces or pressures. FIG. 6A clearly illustrates what occurs when the slats flex inwardly or outwardly. They are effectively shortened within the plane P of the frame to bring the lateral edges 44' of these slab inwardly towards each other or towards the center of the door, decreasing the initial clearance or gap G shown in FIG. 6 until the movable windlock 48' engages the stationary windbar 46' as shown in FIG. 6A. It will be clear that once this occurs, the windbars 46 prevent further inward movements of the windlocks 48' and this, in turn, prevent further flexing or bowing of the slats. The use of a pointed end 48*b* on the windlock 48 and a recess or groove 46" on the windbar 46' is not critical for purposes of the present invention, but help to assure that these protuberances engage and remain engage substantially independently of the magnitudes and directions of the forces F applied to the slats. FIG. 6A also illustrates the maximum bowing or flexing $B_m$ experienced by the slats, these corresponding to the maximum quantities tolerated in accordance with required design specification or regulation.

Figure 14:
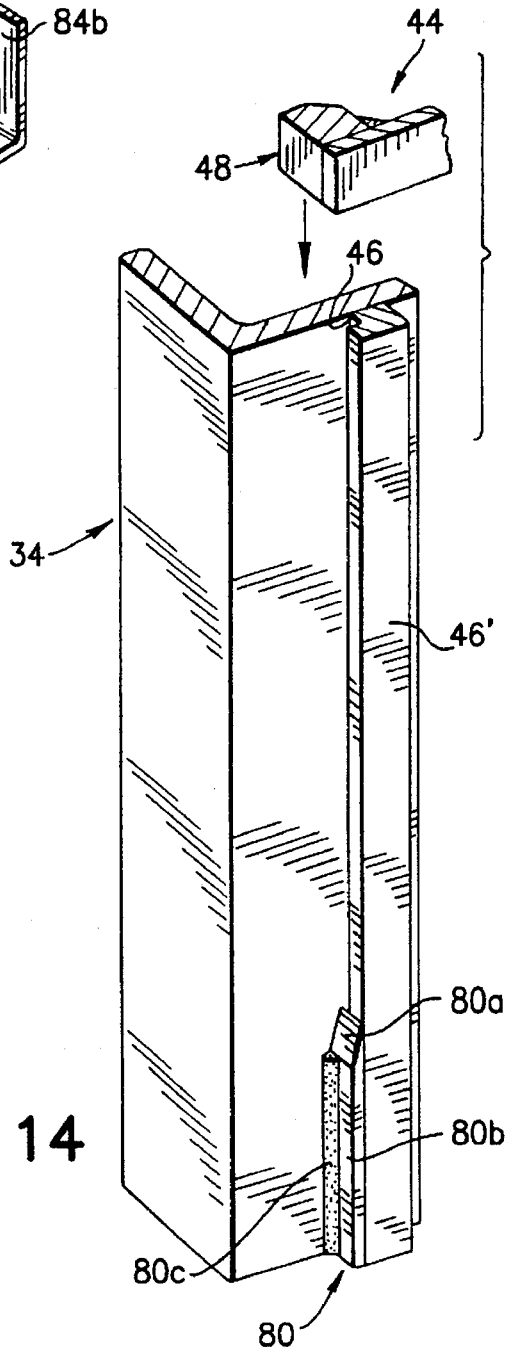
FIG. 14 is a fragmented perspective view of a section of the vertical side portion or guide of the frame shown in FIG. 1, showing the details of the windbar for the intermediate slots of the rolling door as well as for the endmost or bottom slat.
Figure 15:
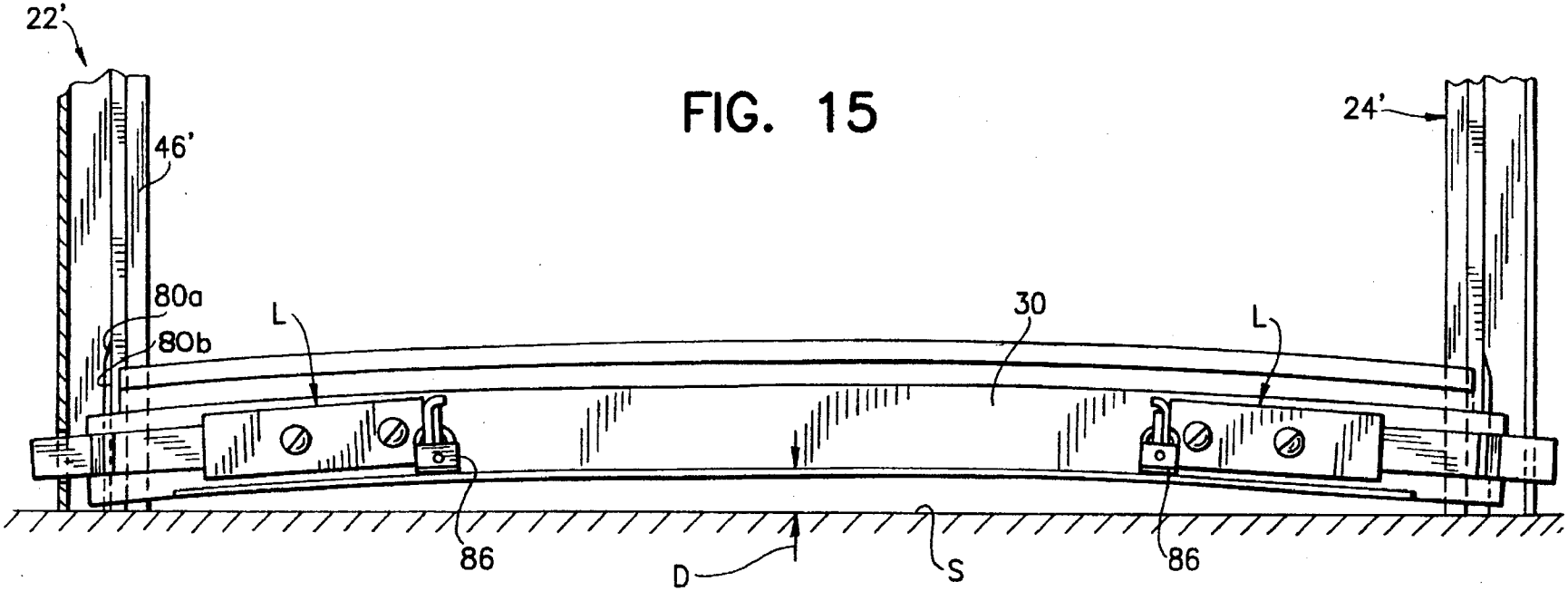
FIG. 15 is a front elevational view of the bottommost or endmost slat of the rolling door corresponding to the top plan view depiction of the flexed or bowed slats or panels shown in FIG. 6A.

The flexing or bowing thus far discussed in connection with FIGS. 6 and 6A relates to movements of the slats outside of the plane P of the frame 16. However, a second type of deflection occurs in relation to the bottommost or endmost slat 30. It will be appreciated that the slats at the upper end of the rolling door are generally well secured because they are wound about a substantially rigid shaft which resists deflection. Therefore, the slats which are situated proximate to the upper rotatably mounted shaft experience minimal deflection. However, there is normally nothing to prevent deflections of the end most slat 30. It will be clear the deflections of the intermediate slats 28 outside of the plane P will not only create an effective shortening along the lengths of the slats, but there will be an upward pulling of the endmost slat 30 in an upward direction as a result of the cumulative bending of the intermediate slats 28. This effect is exaggerated in FIG. 15 in which the bottom slat of bar 30 is illustrated substantially fixed at each vertical side portion 22, 24 by means of slide locks L. However, because there is nothing to prevent upward flexing of the endmost slat 30 in the central region thereof, the cumulative flexing of the intermediate slats pulls the endmost slat 30 to arc upwardly to produce a clearance or deflection D between the lower surface of the endmost or bottom slat or bar 30 and the sidewalk or street level surface S. It will be appreciated that the upward flexing of the endmost slat or bar 30 is likewise made possible as a result of an effective shortening of the slat or bar since the curved or flexed configuration requires a longer length between the slat portions 22, 24 of the frame than when the bar is an a substantially relaxed, straight condition. In accordance with the present invention, a modified windlock and windbar configuration is provided for the endmost slat or bar which substantially eliminates the clearance or gap G between the windbar and windlock even when the endmost slat or bar is in a relaxed or straight condition. This is achieved by providing a wedge 80 (FIG. 14) which includes a transitional inclined surface 80*a* which effectively increases the thickness of the windbar 46 to include a spacer 80*b* which is substantially equal to the dimension of the clearance or gap G. Therefore, it will be clear that the bottommost or endmost slat or bar, once it moves over the wedge 80 is not afforded any clearance or allowed any mobility or flexibility for movement in the direction of the windbar 46. This effectively prevents the lateral edge portion 44 of the endmost or bottommost slat or bar 30 from moving inwardly and, as suggested, this likewise prevents the flexing of such bar. Without the ability to flex, the gap or deflection D (FIG. 15) is substantially minimized or reduced sufficiently to comply with building codes and ordinances established by governmental agencies, counties and municipalities.

Figure 11:
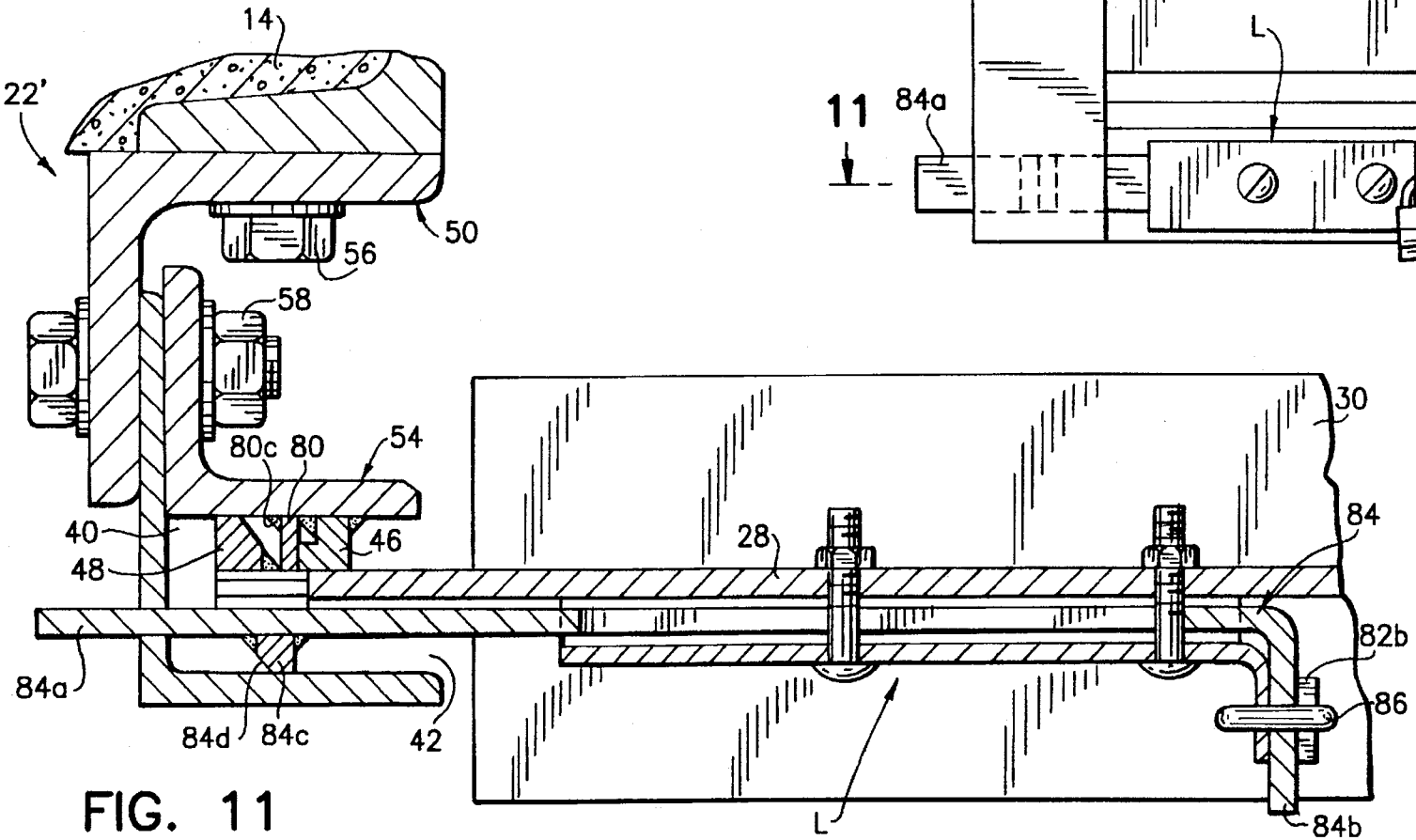
FIG. 11 is similar to FIG. 9 but taken along line 11—11 in FIG. 10.
Figure 12:
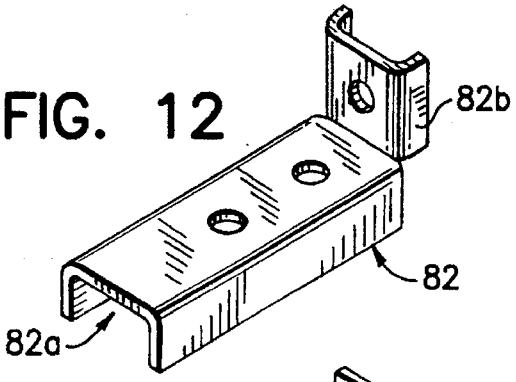
FIG. 12 is a perspective view of the fixed port/on of the lock shown in FIG. 8.
Figure 13:
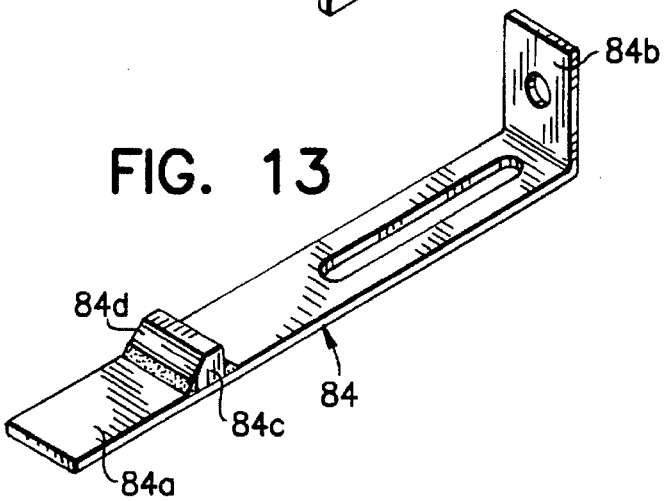
FIG. 13 is a perspective view of the movable portion of the lock shown in FIG. 8.

Referring to FIGS. 8–13, the details of a lock L used to secure the endmost slat or bar 30 to the frame is shown. Such lock is shown merely by way of illustration, it being clear that the specific configuration or design of such lock is not critical for purposes of the present invention. The lock which is illustrated includes a lock portion 82 which is permanently secured to the endmost slat or bar 30 and a portion 84 which has an elongate slide portion 84*a* which is arranged to be slidably moved within the channel 82*a*. When in the closed condition, the slide portion moves into hole H (FIG. 9) and the transverse portion 84*b* moves into proximate position with portion 82*b* so that a padlock 86 can be used to secure these portions 82, 84 to each other. Advantageously, the movable portion 84 includes a wedge 84*c* which is provided with an inclined surface 84*d* as shown in FIG. 13. When the portion 84 is moved to the locking position, the wedge 84*c* slides onto and engages that portion of the angle iron 52 which is opposite to that portion of the other angle iron on which the windbar 46 is mounted. This condition is best shown in FIG. 11, such wedge 84*c* serving as a lock for maintaining the windbar 46 and the windlock in abutment against each other and preventing undesired movements of the lateral edge portion 44 of the endmost slat 30 within the associated slot 42 of the channel 40.

It will be clear, from the above, that the use of appropriate protuberances within the channels 40, with and without clearances or gaps G, can be effective to prevent excessive or any flexing of the slats. By controlling the extent of flexing, the sizes of the resulting deflections or gaps D can be limited or substantially eliminated. Such design, therefore, makes it possible to conform with the codes and regulations of various governmental regulations and significantly decrease the amount of damage closures, such as windows and doors, which can be inflicted by hurricanes, tornadoes, etc.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention.

I claim:

1. A wind-resistant overhead closure for a generally rectangular opening in a wall of a building structure, comprising a frame defining a plane and dimensioned to conform to the wall opening, said frame including an upper horizontal portion and spaced vertical side portions; a rolling planar member having an endmost closure portion which is variably movable from said upper horizontal portion and a plurality of intermediate closure portions between said upper horizontal portion and said endmost closure portion, said closure portions extending between said side portions and having lateral edge portions which cooperate with and are guided by said frame side portions; rolling means generally extending along said upper horizontal portion for rolling up said rolling planar member about an axis generally co-extensive with said upper horizontal portion of said frame to open the overhead closure and for unrolling said rolling member and guiding said lateral edge portions along associated vertical side portions to close the overhead closure, said vertical side portions including first stop means for limiting the lateral movements of said lateral edge portions of said intermediate closure portions beyond a predetermined amount at each side portion towards the other side portion and second stop means for substantially preventing any lateral movements of said lateral edge portions of said endmost closure portion, said first and second stop means controlling the extent of inward movements of said edge portions and thereby limiting the amount of flexing of said intermediate closure portions of said rolling closure due to wind loads on the closure in relation to the plane of said frame and flexing of said endmost closure portion in the direction of said upper horizontal portion of said frame.

2. An overhead closure as defined in claim 1, wherein said upper horizontal portion includes a generally horizontal rotatably mounted shaft about which said rolling closure can be rolled up.

3. An overhead closure as defined in claim 1, wherein said rolling member is formed of a series of slats adjacent ones of which are articulartively connected to each other, each slat having lateral edge portions which cooperate with said frame side portions.

4. An overhead closure as defined in claim 1, wherein each of said vertical side portions defines a generally vertical channel for receiving associated lateral edge portions for guided vertical movements within said vertical channels during opening and closing of said rolling member, each of said vertical channels being open on a side thereof facing the other of said channels to form a slot through which said lateral edge portions of said rolling member can extend.

5. An overhead closure as defined in claim 4, wherein said channels are formed by a pair of spaced flanges of two angle irons arranged as an "F" mount.

6. An overhead closure as defined in claim 4, wherein said channels are formed by a pair of spaced flanges of three angle irons arranged as a "Z" mount.

7. An overhead closure as defined in claim 5, wherein said channels are formed by a pair of spaced flanges of three angle irons arranged as an "E" mount.

8. An overhead closure as defined in claim 4, wherein said stop means in each channel comprises first and second protuberance means arranged in each slot and on an associated lateral edge portion, respectively, said first and second protuberance means of said first stop means normally being spaced from each other a predetermined distance to provide a predetermined clearance between said first and second protuberance means when said rolling member is not subjected to a wind load to facilitate opening and closing of said rolling member when arranged in said plane of said frame, flexing of said rolling member, when subjected to a wind load, causing said first and second protuberance means to engage each other to inhibit further movements of opposing lateral edge portions towards each other to thereby prevent further flexing of said rolling member beyond a predetermined amount of flexing.

9. An overhead closure as defined in claim 8, wherein said first and second protuberance means comprise spaced first and second hook members arranged to engage and lock in abutment against each other when flexing of said rolling member reaches said predetermined amount of flexing.

10. An overhead closure as defined in claim 8, wherein said first and second protuberance means comprise spaced first and second members having stop surfaces which engage against each other when flexing of said rolling member reaches said predetermined amount of flexing to prevent further flexing.

11. An overhead closure as defined in claim 8, wherein said predetermined clearance is no greater than approximately 1.5 inches for rolling members up to approximately 28 feet.

12. An overhead closure as defined in claim 11, wherein said rolling member is approximately 12 feet wide and said predetermined clearance is approximately 0.344 inches.

13. An overhead closure as defined in claim 11, wherein said rolling member is approximately 16 feet wide and said predetermined clearance is approximately 0.5875 inches.

14. An overhead closure as defined in claim 11, wherein said rolling member is approximately 20 feet wide and said predetermined clearance is approximately 0.875 inches.

15. An overhead closure as defined in claim 11, wherein said rolling member is approximately 24 feet wide and said predetermined clearance is approximately 1.25 inches.

16. An overhead closure as defined in claim 11, wherein said rolling member is approximately 28 feet wide and said predetermined clearance is approximately 1.5 inches.

17. An overhead closure as defined in claim 8, wherein said first and second protuberance means of said second stop means being in abutment against each other when the closure is closed and said endmost closure portion is most remote from said upper horizontal portion, whereby said second stop means for said endmost portion defines a clearance of zero to thereby prevent any movements of said lateral edge portions associated with said endmost portion and flexing thereof out of said plane of said frame.

18. An overhead closure as defined in claim 17, wherein said first and second protuberance means associated with said endmost portion substantially engage each other when said rolling member is closed and said endmost portion is at a point most remote from said upper horizontal portion.

19. An overhead closure as defined in claim 18, further comprising tapered means proximate to said most remote point of said endmost portion for providing a transition in said clearance from said predetermined clearance to zero clearance.

20. An overhead closure as defined in claim 19, further comprising locking means for maintaining said first and second protuberance means in abutment against each other and preventing undesired movements of said lateral edge portions of said endmost portion within associated slots of said channels.

* * * * *